US005299627A

United States Patent [19]

Sorimachi et al.

[11] Patent Number: 5,299,627

[45] Date of Patent: Apr. 5, 1994

[54] CONTINUOUS CASTING METHOD

[75] Inventors: Kenichi Sorimachi; Hirokazu Tozawa; Seiji Itoyama; Shuji Takeuchi; Akira Yamauchi, all of Chiba, Japan

[73] Assignee: Kawasaki Steel Corporation, Kobe, Japan

[21] Appl. No.: 845,232

[22] Filed: Mar. 3, 1992

[51] Int. Cl.[5] ..... B22D 11/04; B22D 11/07

[52] U.S. Cl. ..... 164/472; 164/473; 164/478

[58] Field of Search ..... 164/472, 473, 478

[56] References Cited

U.S. PATENT DOCUMENTS

| | | | |
|---|---|---|---|
| 3,318,363 | 5/1967 | Goss | 164/472 |
| 3,642,052 | 2/1972 | Schrewe et al. | 164/473 |
| 4,460,034 | 7/1984 | Saeki et al. | 164/478 |
| 4,508,571 | 4/1985 | Nakato et al. | 164/472 X |

FOREIGN PATENT DOCUMENTS

| | | | |
|---|---|---|---|
| 0141523 | 5/1985 | European Pat. Off. | 164/473 |
| 51-50819 | 5/1976 | Japan . | |
| 59-153550 | 9/1984 | Japan . | |
| 61-195744 | 8/1986 | Japan | 164/472 |
| 63-30160 | 2/1988 | Japan | 164/472 |
| 63-188462 | 8/1988 | Japan | 164/473 |
| 3-106545 | 5/1991 | Japan | 164/472 |
| 1252353 | 8/1986 | U.S.S.R. | 164/473 |

*Primary Examiner*—J. Reed Batten, Jr.
*Attorney, Agent, or Firm*—Dvorak and Traub

[57] ABSTRACT

Steel is continuously cast while adding a mold powder using a vertical continuous casting mold having two pairs of mold surfaces which form a casting cavity, wherein the surface temperature of the mold is kept at 700° C. or more by forming the mold surfaces of a Ni-Cr alloy, and a mold powder having a solidifying point lower than the surface temperature is used so that the mold powder is maintained in a liquid-phase state.

4 Claims, 7 Drawing Sheets

PRIOR ART

CONTINUOUS CASTING METHOD

BACKGROUND OF THE INVENTION

1. Field of the Invention

The present invention relates to a vertical continuous casting method and a casting mold therefor, and particularly to a continuous casting process for producing high-quality cast materials having few defects such as surface cracks, oscillation marks and the like.

2. Description of the Related Art

A continuous casting method has recently been employed in a steel making step in order to attempt to increase the yield by simplifying the process and decrease the cost by saving energy.

In order to improve productivity, attempts have also been made to decrease the casting time by increasing the casting speed.

Increased casting speed, however, increases the occurrence of breakouts during casting and surface defects such as surface cracks in the cast material.

It is known that longitudinal cracks are caused by nonuniform cooling in a casting mold.

To prevent the occurrence of longitudinal cracks, it is important to prevent formation of non-uniform solidified shell.

Prior art means proposed for preventing the occurrence of non-uniformity of solidified shell include moderation of cooling of a cast material by providing a grooved inner surface of a water-cooling casting mold as disclosed in Japanese Patent Laid-Open No. 51-50819. Japanese Patent Laid-Open No. 59-153550 discloses the moderation of heat transfer by coating a ceramic on the inner surface of a water-cooling copper casting mold.

The method disclosed in Japanese Patent Laid-Open No. 51-50819, however, does not sufficiently moderate cooling and is thus incapable of preventing the occurrence of surface defects. In the method disclosed in Japanese Patent Laid-Open No. 59-153550, separation is formed between a copper plate and the ceramic phase layer due to a difference in thermal expansion between the copper plate and the ceramic, and thus the mold cannot tolerate practical use.

As a result of detailed investigation of the cooling step of a continuous casting method performed by the inventors using a mold powder, it was found that nonuniform solidification of a cast material is mainly produced by the causes described below with reference to FIG. 11. FIG. 11 is a sectional view showing the state wherein molten steel 5 is continuously cast into a mold 1 through an immersion nozzle 4. The casting mold 1 comprises a mold material 2 and a back frame 3. In the mold 1, the poured molten steel 5 first contacts the mold 1 which is cooled with water to form a thin solidified shell 6.

As the temperature decreases, the solidified shell 6 then contracts and separates from the mold 1 to form a gap, i.e., an air gap layer 11, between the mold 1 and the solidified shell 6. The solidified shell 6 maintains its shape by a support roll 12 and is successively drawn downward by a drawing apparatus (not shown) such as a pinch roll. At this time, the mold powder 8 is sprayed on the meniscus 7 in order to prevent sticking between the mold 1 and the solidified shell 6, and improve lubricating properties. The mold powder 8 also functions to absorb and remove the floating nonmetallic inclusion, keep the molten steel 5 hot, and prevent re-oxidation.

The mold powder 8 is caused to flow into the gap between the mold 1 and the solidified shell 6 and is solidified to form a solid mold powder 9 between the mold 1 and the solidified shell 6. The solidifying point of the mold powder 8 is generally about 1000° to 1100° C. On the other hand, the surface temperature of the mold is designed to be 400° C. or lower, since the conventional mold material 2 is generally made of copper alloy which although has high thermal conductivity, suitable for the mold material, high-temperature strength of copper is not so high.

The mold powder 8 is thus solidified on the side of the mold material 2 to form the air gap layer 11 between the mold powder 8 and the casting mold 1. The formation of such an air gap layer 11 significantly decreases the quantity of heat extracted from the mold 1 and thus causes the formation of the nonuniform solidified shell 6. This causes the occurrence of longitudinal cracks on the surface of the cast material and breakouts thereof in combination with thermal stress.

SUMMARY OF THE INVENTION

It is an object of the present invention to solve the above problems and provide a vertical longitudinal casting method and a casting mold therefor which is capable of achieving uniform shell solidification and stable casting without producing surface cracks and occurrence of breakouts.

In order to achieve the object, a vertical longitudinal casting method of the present invention comprises the steps of continuous casting steel into the vertical continuous casting mold formed by two pairs of mold surfaces, while adding a mold powder thereto, wherein the surface temperature of the casting mold is kept at 700° C. or more, and the mold powder is kept in a liquid phase state by using a molding powder having a solidifying point lower than the surface temperature of the casting mold, and adjusting the inflow of the mold powder while longitudinally oscillating the casting mold.

In the casting method, the casting mold is transversely oscillated with the same period as that of the longitudinal oscillation in the direction in which the distance between the two opposite mold surfaces is changed so that the phase of the transverse oscillation relative to the longitudinal oscillation is changed.

In order to achieve the above continuous casting method of the present invention, there is provided a continuous casting mold comprising a mold material made of Ni-Cr alloy, having low thermal conductivity and containing cooling water passages, and a back frame provided with a cooling water supply passage for leading cooling water to the cooling water passages.

Other constitutions and variations of the present invention will be made clear from the detailed description of the invention below.

DESCRIPTION OF PREFERRED EMBODIMENTS

The present invention has been achieved for decreasing the air gap produced between a casting mold and a mold powder.

Figure 1:
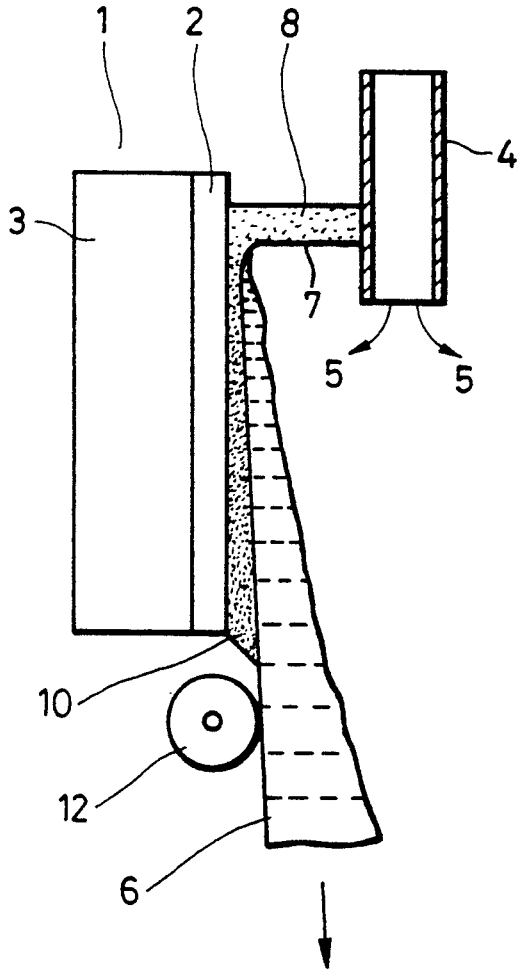
FIG. 1 is an explanatory view of a casting mold in accordance with an embodiment of the present invention.
Figure 11:
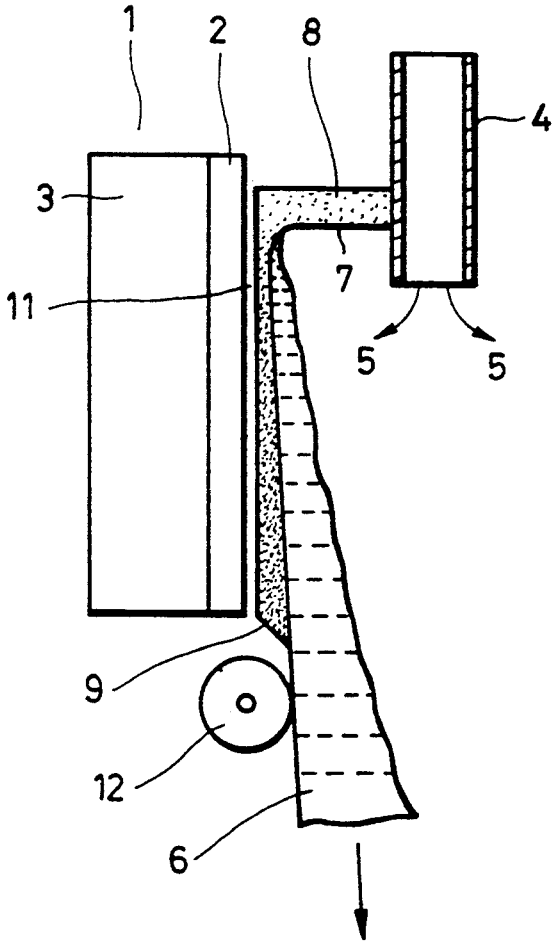
FIG. 11 is a drawing explaining the case where a conventional prior art continuous casting mold is used.

The operation of the casting mold of the present invention is described below with reference to FIG. 1. The present invention is characterized in that the mold material is changed from a copper alloy to a Ni-Cr alloy having low thermal conductivity (about 1/20 of that of a copper alloy mold), and in that the surface temperature of the mold material is 700° C. or more, and a mold powder having a solidifying point lower than the surface temperature of the mold is used. Since casting is performed at a surface temperature of the mold material kept at a temperature higher than the solidifying temperature of the mold powder, a mold powder 8 becomes a liquid-phase mold powder 10 which does not assume a solid phase state but is maintained in a liquid phase state between a mold 1 and a solidified shell 6. The air gap layer 11 formed in the conventional method shown in FIG. 11 is thus significantly decreased. This permits a decrease in nonuniform solidification of the solidified shell 6.

Figure 2:
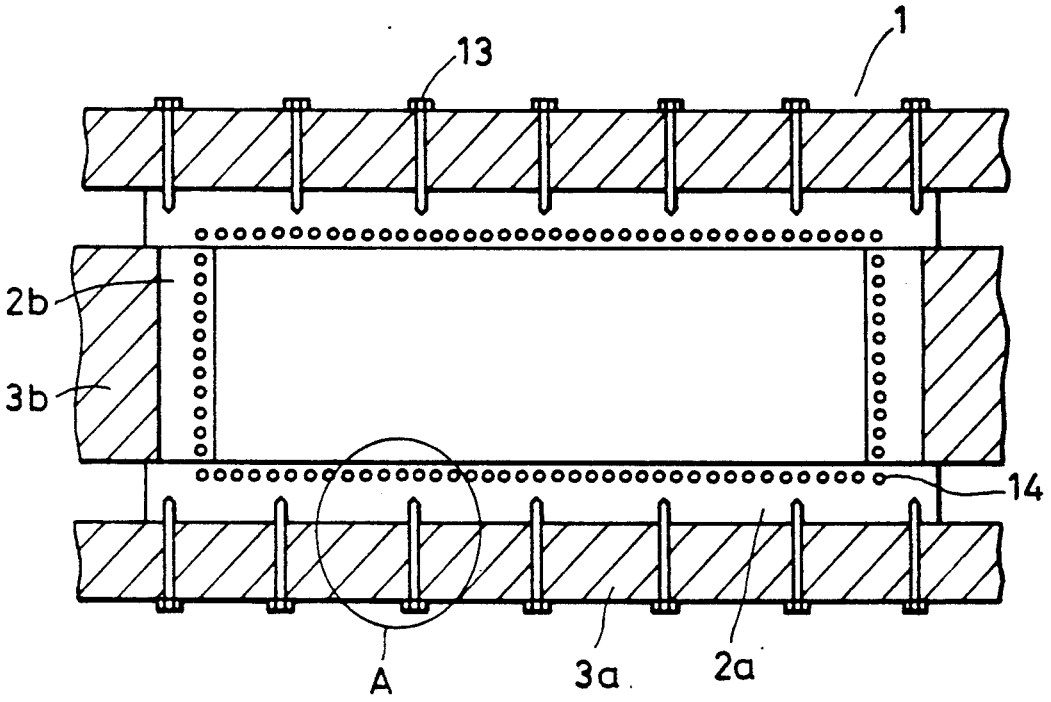
FIG. 2 is a plan cross-sectional view of the casting mold in accordance with an embodiment of the present invention.
Figure 3:
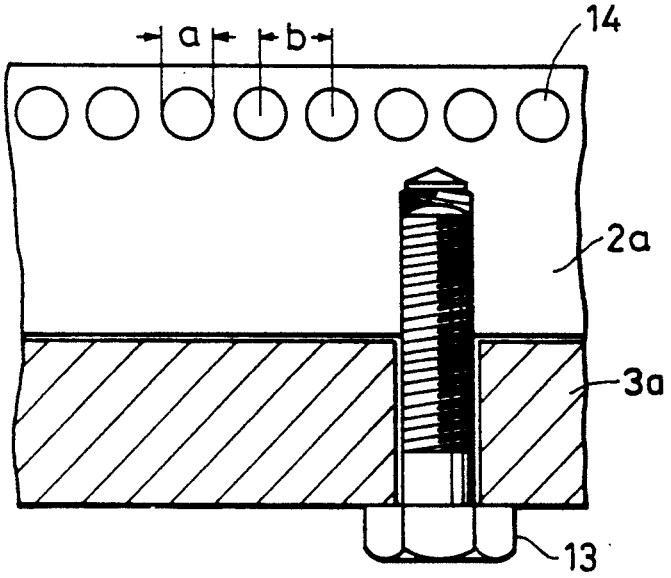
FIG. 3 is an enlarged view of the portion A shown in FIG. 2.
Figure 4:
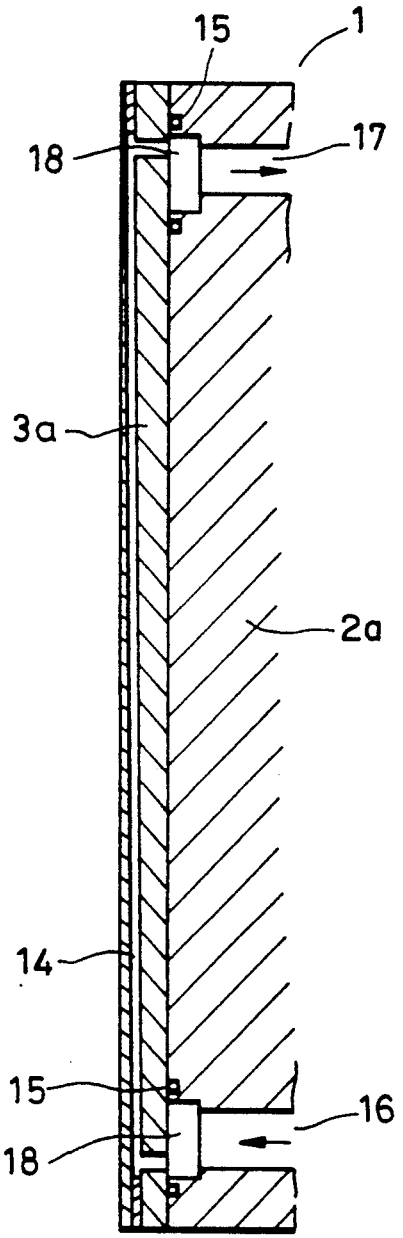
FIG. 4 is a longitudinal sectional view of the mold shown in FIG. 1.

FIGS. 2 to 4 are drawings explaining a casting mold in accordance with an embodiment of the present invention. FIG. 2 is a plan cross-sectional view of the casting mold in accordance with an embodiment of the present invention, FIG. 3 is an enlarged view of the portion A shown in FIG. 2, and FIG. 4 is a longitudinal sectional view of FIG. 1.

In the drawings, reference numeral 2*a* denotes a long-side mold material; reference numeral 2*b*, a short-side mold material; reference numeral 3*a*, a long-side back frame; reference numeral 3*b*, a short-side back frame; reference numeral 13, a bolt for fixing the mold frame to the back frame; reference numeral 14, cooling water passages; reference numeral 15, an O-ring; reference numeral 16, a cooling water supply passage; reference numeral 17, a drainage; and reference numeral 18, a cooling water header.

Inconel 718 was used as the mold material 2. As shown in FIG. 3, the dimensions of the cooling water passages 14 were as follows:

Hole diameter: a=10 mm

Hole pitch: b=15 mm

As shown in FIG. 4, the distance from the cooling water passages 14 to the surface of the mold material 2 is increased from 4 mm in the upper portion to 12 mm in the lower portion in the casting direction. This is described in detail below.

If it is assumed that:

mold material surface temperature: Ts (°C.)

distance between the cooling water passage and the mold material surface (thickness): t (m)

thermal conductivity of mold material: λ (Kcal/m hr °C.)

thermal conductivity coefficient between cooling water and mold: hw (Kcal/m$^2$hr °C.)

cooling water temperature: Tw (°C.)

heat flow flux: q (Kcal/m$^2$ hr), the following equation is established:

$$Ts=(t/\lambda+1/hw)q+Tw$$

Figure 5:
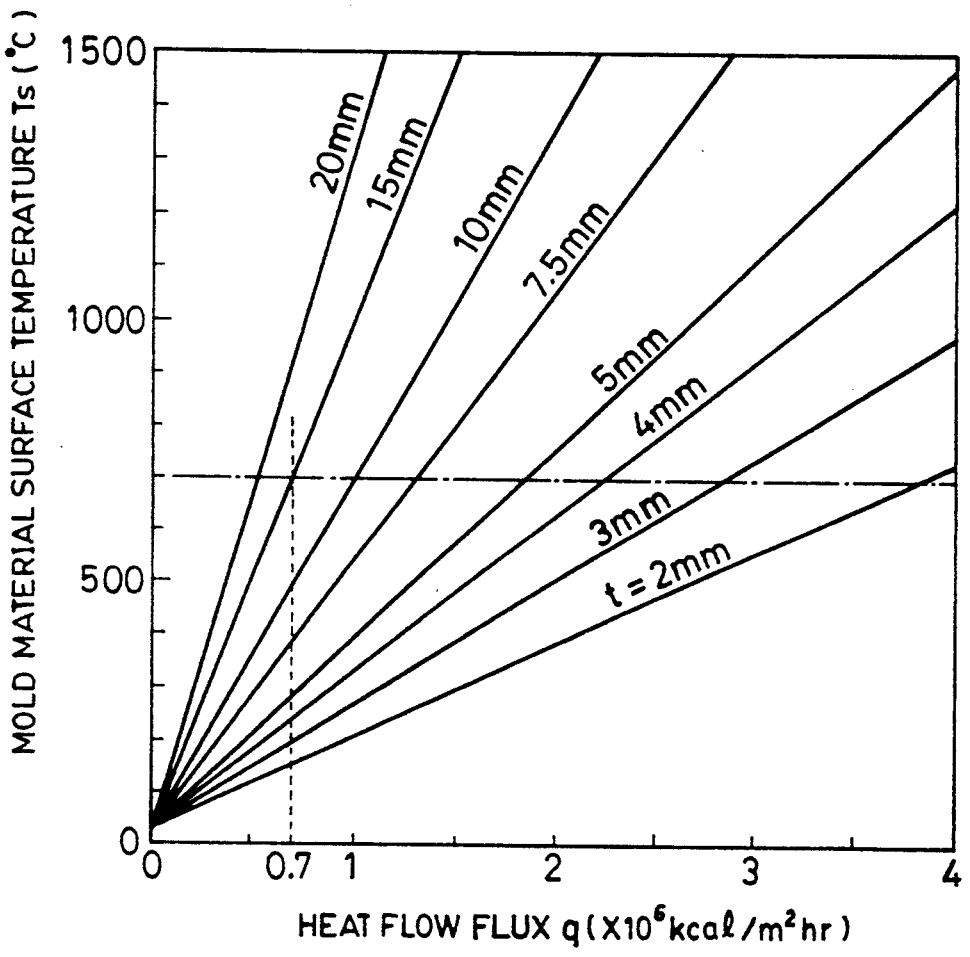
FIG. 5 is a graph showing a relation between the heat flow flux and the mold material surface temperature when plate thickness is used as a parameter.

If,

Tw=30° C.

hw=20,000 Kcal/m$^2$ hr °C.

λ=20 Kcal/m hr °C. (800° C.), the relation between the heat flow flux q and the mold material surface temperature Ts, depending upon the distance between the cooling water passages and the mold material surface, is as shown in FIG. 5.

It is estimated that the heat flow flux of the meniscus portion is about $240\times10^4$ Kcal/m$^2$ hr at a casting speed of 1.8 m/min and $400\times10^4$ Kcal/m$^2$ hr at a casting speed of about 4 m/min. The heat flow flux at the outlet of the casing mold is about $70\times10^4$ Kcal/m$^2$ hr at a casting speed of 1.0 m/min.

It is therefore necessary that the distance t between the mold material and the cooling water passages is about 2 to 15 mm.

Since the heat flow flux in a portion near the meniscus is generally large, and that in the lower portion of the mold is small, it is preferable for obtaining a uniform mold material surface temperature in the casting direction that the distance t in the meniscus portion is small, and the distance in the lower portion of the mold is large.

As a result of thermal numerical analysis of the temperature profile of the casting mold comprising the above mold material, the highest surface temperature of the casting mold was 825° C. between the respective cooling water holes. It was recognized that, under the above casting conditions, the quantity of heat extracted (mold cooling water flow rate×cooling water temperature rise) is increased by about 20%, as compared with a conventional copper alloy mold. A decrease in the air gap layer was also recognized. It was recognized from FeS addition tests that the non-uniformity of the widthwise thickness of the solidified shell is improved.

For the above reasons, it is estimated that, even when the casting speed is increased, the solidified shell layer at the lower end of the casting mold is increased due to uniformity and increase in the quantity of heat extracted thereby decreasing the risk of breakouts.

When Inconel 718 was used as the mold material 2, since the high-temperature strength (0.2% strength) at 800° C. was as high as 75 kg/mm$^2$, the mold was not thermally deformed after casting and could be used for a long time.

Waspaloy which is an Ni-Cr alloy shown in Table 1 can also be used as the mold material because of its high strength at a high temperature.

It is thus desirable for obtaining high strength at a high temperature to use a material having a thermal conductivity of 25 Kcal/m hr °C.

In order to decrease the friction between the mold 1 and the solidified shell 6, it is important to longitudinally oscillate the mold 1 while adding the mold powder 8 to the molten steel in the mold 1. The function of the mold powder 8 is closely related to the oscillation conditions of the mold 1, and it is important to appropriately adjust the amount of the mold powder 8 for stabilizing the casting.

Figure 6:
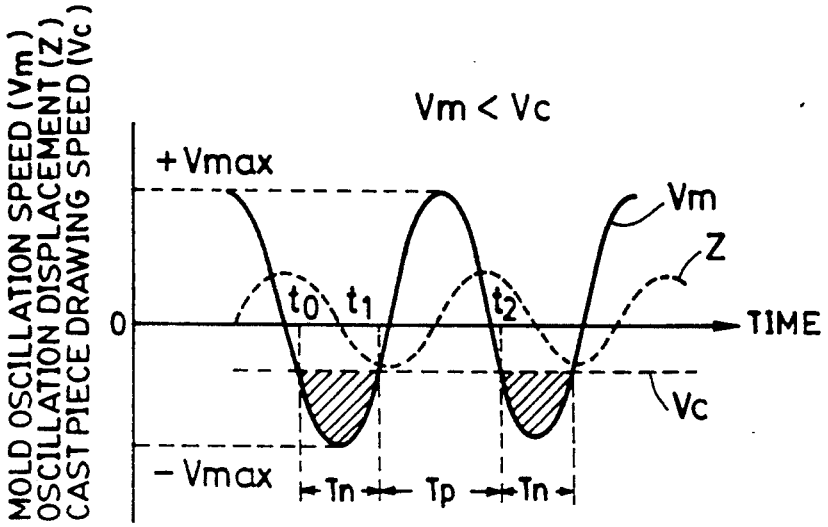
FIG. 6 is a graph showing changes of the oscillation speed of a mold, the cast material drawing speed and oscillation displacement with the passage of time.

This is described below with reference to FIG. 6. In FIG. 6, the time the mold oscillation speed Vm is lower than the cast material drawing speed Vc and the time the mold oscillation speed Vm is higher than the cast material drawing speed Vc are shown by positive strip time Tp and negative strip time Tn, respectively.

In the casting method of the invention, the mold is oscillated so that when the longitudinal oscillation period of the mold is within the positive strip time Tp, the distance between the mold 1 and the solidified shell 6 is increased by moving a pair of mold surfaces in a backward direction, and when the period is within the negative strip time Tn, the distance is decreased by moving the pair of mold surfaces in a forward direction. Conversely, when the oscillation period is within the positive strip time Tp, the pair of mold surfaces are moved forward, and when the oscillation period is within the negative strip time Tn, the pair of mold surfaces are moved backward.

Figure 7A:
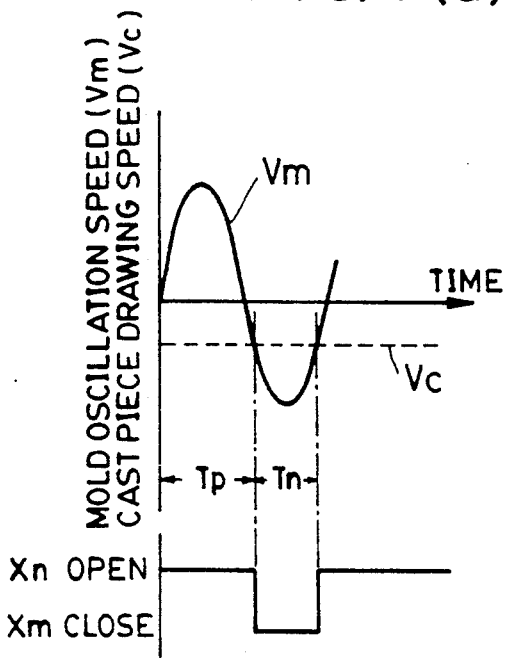
FIGS. 7(*a*) and 7(*b*) are graphs showing the longitudinal oscillation waveform and the backward and forward timing of a mold.
Figure 7B:
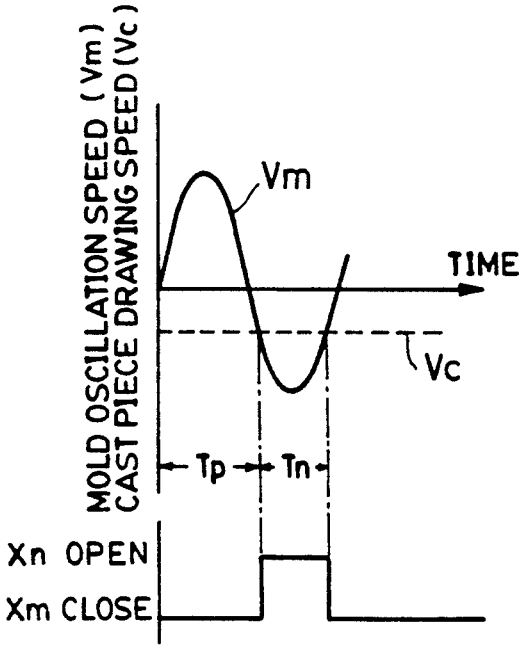

As shown in FIG. 7(*a*), the oscillation of the vertical continuous casting mold causes the mold to be moved backward in the positive strip time Tp so as to increase the distance between the mold and the solidified shell, whereby an appropriate amount of mold powder is caused to flow into the space between the mold and the solidified shell. Since the frictional force between the mold surfaces and the solidified shell is thus decreased, the solidified shell is prevented from sticking to the mold surfaces.

Figure 8:
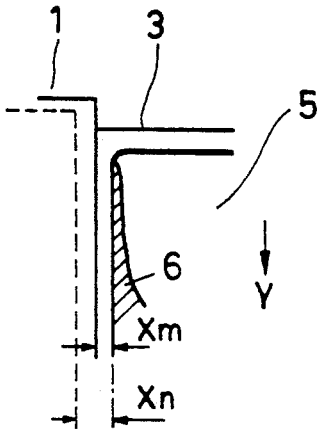
FIG. 8 is a schematic drawing of the space between a casting mold and a cast material.

The oscillation of the vertical continuous casting mold causes the mold 1 to be moved backward so as to increase the distance Xm shown in FIG. 8 (distance between a usual mold and solidified shell) to a distance Xn within the positive strip time Tp and causes the mold to be moved forward in the direction vertical to the drawing direction so as to return the distance to the original value Xm in the negative strip time Tn. During casting, if an excessive gap is produced between the long-side mold material and the short-side mold material, the molten steel may enter the gap and create casting problems. It is thus preferable that the backward moving amount (Xn−Xm) of the mold is 1 mm or less. On the other hand, if the frictional force between the mold and the solidified shell is considered, the frictional force F applied to the solidified shell is expressed by the following equation (1):

$$F = A\mu \frac{d\tilde{V}}{dX} \quad (1)$$

wherein

A: area of contact between mold and solidified shell $\mu$: viscosity of mold powder flowing between mold surface and solidified shell $\tilde{V}$: relative speed between mold surface and solidified shell X: distance between mold and solidified shell The frictional force F is the maximum tensile stress of the cast material when the mold is moved upward at the highest speed (positive strip time Tp). It is effective to increase the distance X between the mold and the solidified shell in the positive strip time Tp because the distance is inversely proportional to the frictional force F.

However, when a conventional prior art copper mold was used, even if the distance X between the mold and the solidified shell was increased, since a solidified layer of the mold powder 8 was present on the side of the mold 1, an increase in X is compensated by an increase in inflow of the mold powder 8 and an increase in the air gap layer 11. It was thus observed that when an increase in the air gap layer 11 is nonuniform over the whole mold surface, nonuniform solidification is promoted.

The thickness of Inconel 718 used as the mold material 2 is thus 5 mm in order to decrease the air gap layer 11. As a result of thermal numerical analysis of the mold surface temperature when the mold material 2 was used, a highest temperature of 825° C. was obtained at a position between slits. In addition, when non-uniformity of the widthwise thickness of the solidified shell was measured by adding FeS during casting, it was recognized that the non-uniformity was improved by using Inconel 718.

When the above mold material was used, even if the casting speed was increased, the thickness of the solidified shell at the lower end of the mold was made uniform, and the oscillation of the mold decreases the tensile stress applied to the solidified shell and thus enables casting without producing breakouts.

When Inconel 718 was used, the high-temperature strength (0.2% strength) at 800° C. was as high as 70 kg/mm$^2$, and the mold was not thermally deformed after casting and, therefore, could be used for a long time.

Figure 9:
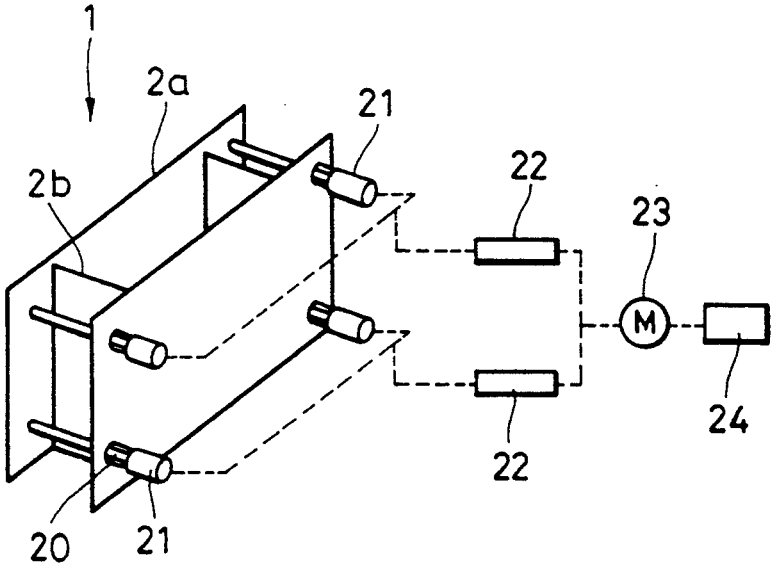
FIG. 9 is an explanatory perspective view of an apparatus in accordance with an embodiment of the present invention.

FIG. 9 is an explanatory perspective view of an apparatus which can preferably be used in the method of the present invention. Since a slab continuous casting machine generally has means for clamping the short-side mold material 2*b* by using the long-side mold material 2*a*, the apparatus of this embodiment comprises a hydraulic pump 23 for driving hydraulic cylinders 21 through solenoid valves 22 so as to prevent the formation of a small gap between the long-side mold material 2*a* and the short-side mold material 2*b*. In FIG. 9, reference numeral 20 denotes clamp springs; and reference numeral 24 denotes a hydraulic tank. One end of each of the hydraulic cylinders is fixed to a fixed frame (not shown).

Although, in this embodiment, the upper and lower portions of the long-side mold material 2*a* are simultaneously moved forward and backward by the hydraulic cylinders 21, the present invention is not limited to this. If only the upper portion is moved by the hydraulic cylinders around the lower portion of the long-side mold material 2*a* serving as a center so that the distance between the mold and the solidified shell is changed, the same effects can be obtained.

Embodiment 1

Medium carbon steel of 1200 mm wide and 220 mm thick was formed by casting under the following conditions:

Casting speed: 1.2 m/min
Oscillation cycle: 130 cpm
Oscillation stroke: 6 mm

The mold materials M1 and M2 (composition shown in Table 1) were used for a mold of the type shown in FIGS. 3 and 4 and having a hole diameter of 10 mm and a hole pitch of 15 mm, and the mold material M3 (composition shown in Table 1) was used for a conventional mold.

Table 1 shows the components, thermal conductivity and high-temperature 0.2% strength of the mold materials of this embodiment, and Table 2 shows the components, viscosity and solidifying point of mold powders. Table 3 shows the results of the tests performed.

As seen from Table 3, mold powders P1 and P2 can be used when the mold material M2 of the present invention, and mold powders P1, P2 and P3 can be used when the mold material M1 is used.

In this way, the surface temperature of the mold can be increased to a value higher than the solidifying point of the mold powder used. Since the mold powder in a solid-phase state is thus absent on the surface side of the mold, the mold powder in a liquid-phase state is filled in the space between the solidified shell and the mold, thereby preventing the formation of the air gap layer therebetween.

Embodiment 2

The mold material M1 of the present invention shown in Table 1 and the conventional mold material M3, and the mold powders P1 and P4 shown in Table 2 were used.

Figure 10:
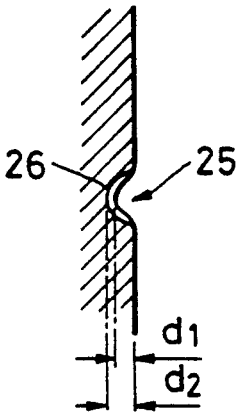
FIG. 10 is a schematic drawing showing an oscillation mark and a segregation layer.

The distance between the mold and the solidified shell was increased by moving the mold backward by oscillation during the negative strip time Tn so that a sufficient amount of mold powder was caused to flow into the space between the mold and the solidified shell, as shown in FIG. 8. Table 4 shows the depth d1 of the cast material oscillation mark 25 and the depth d2 (refer to FIG. 10) of the segregation layer 26 when a cast material SUS304 was obtained by casting using the mold under transverse oscillation. For comparison, Table 4 also shows the depths d1 and d2 when the mold was oscillated with a conventional sine waveform.

As seen from Table 4, the method of the present invention enables the oscillation mark depth and segregation layer depth to be significantly decreased. In addition, the use of Inconel 718 and a low-solidifying point powder permits a decrease in the non-uniformity of solidification and a decrease in longitudinal cracking. The present invention enables a solidified shell to be uniformly formed by controlling the inflow of the mold powder between the mold surface and the solidified shell and inhibiting the production of an air gap layer. It is thus possible to prevent the occurrence of breakouts and decrease oscillation, thereby producing a cast material having excellent surface properties. The present invention thus has the excellent effect of improving the productivity of the continuous casting operation.

TABLE 1

| Mold Material Name | M1 Inconel 718 | M2 Waspaloy | M3 Cu (CCM-A) (Conventional Mold) |
|---|---|---|---|
| Component (wt %) | | | |
| C | <0.1 | 0.07 | |
| Si | <0.75 | <0.15 | |
| Mn | <0.5 | <0.1 | |
| Ni | 52 | 57.5 | |
| Co | — | 14 | |
| Cr | 19 | 19 | 0.5 to 1.5 |
| Mo | 3 | 4 | |
| Fe | 19 | 1 | |
| Al | 0.5 | 1.3 | |
| Ti | 0.9 | 3 | |
| Nb + Ta | 5.1 | — | |
| Zr | | | 0.08 to 0.30 |
| Cu | | | ≧98.0 |
| Thermal Conductivity (Kcal/mh °C.) | | | |
| Room temperature | 9.8 | 9.2 | 300 |
| 400° C. | 15.0 | 13.7 | 315 |
| 800° C. | 20.4 | 19.5 | — |
| High-Temperature 0.2% Strength (Kgf/mm²) | | | |
| Room Temperature | 115 | 80.8 | 35 |
| 400° C. | 108 | 76 | 27 |
| 800° C. | 75 | 63 | — |

TABLE 2

| Mold Powder | P1 | P2 | P3 | P4 |
|---|---|---|---|---|
| Component (wt %) | | | | |
| $SiO_2$ | 34.9 | 33.1 | 34.1 | 37.9 |
| CaO | 15.9 | 23.1 | 22.0 | 32.8 |
| $Al_2O_3$ | 4.3 | 2.0 | 1.7 | 3.7 |
| $Fe_2O_3$ | 0.3 | 1.4 | 0.1 | 0.1 |
| $Na_2O$ | 14.3 | 13.5 | 16.4 | 14.2 |
| F | 9.1 | 9.1 | 11.6 | 9.1 |
| BaO | 5.9 | — | 5.2 | — |
| MnO | — | 2.2 | 4.4 | — |
| $TiO_2$ | — | 5.0 | — | — |
| MgO | 6.0 | — | 0.8 | — |
| $B_2O_3$ | — | 5.0 | — | — |
| $CaO/SiO_2$ | 0.46 | 0.70 | 0.64 | 0.87 |
| Viscosity (at 1300° C., poise) | 1.7 | 1.4 | 1.1 | 2.0 |
| Freezing Point (°C.) | 680 | 750 | 810 | 110 |

TABLE 3

| Experiment Series No. | Mold Material | Mold Thickness t (mm)* | Mold Surface Temperature (°C.)* | Mold Powder | Mold Powder Freezing Point (°C.) | Heat Flow Rate (Index)* | Surface Crack (Index) |
|---|---|---|---|---|---|---|---|
| Mold of This Invention | | | | | | | |
| This Invention | | | | | | | |
| 1 | M2 | 6 | 750 | P1 | 680 | 1.30 ± 0.04 | 0.21 |
| 2 | M2 | 6 | 750 | P2 | 750 | 1.15 ± 0.10 | 0.48 |
| Comparison | | | | | | | |
| 3 | M2 | 6 | 750 | P3 | 810 | 1.12 ± 0.21 | 0.80 |
| 4 | M2 | 6 | 750 | P4 | 1110 | 1.09 ± 0.28 | 0.85 |
| This Invention | | | | | | | |

TABLE 3-continued

| Experiment Series No. | Mold Material | Mold Thickness t (mm)* | Mold Surface Temperature (°C.)* | Mold Powder | Mold Powder Freezing Point (°C.) | Heat Flow Rate (Index)* | Surface Crack (Index) |
|---|---|---|---|---|---|---|---|
| 5 | M1 | 6 | 825 | P1 | 680 | 1.35 ± 0.02 | 0.15 |
| 6 | M1 | 6 | 825 | P2 | 750 | 1.31 ± 0.03 | 0.18 |
| 7 | M1 | 6 | 825 | P3 | 810 | 1.25 ± 0.06 | 0.25 |
| Comparison 8 Conventional Mold | M1 | 6 | 825 | P4 | 1110 | 1.11 ± 0.25 | 0.83 |
| 9 | M3 | 25 | 400 | P1 | 680 | 1.08 ± 0.35 | 0.97 |
| 10 | M3 | 25 | 400 | P2 | 750 | 1.02 ± 0.40 | 0.98 |
| 11 | M3 | 25 | 400 | P3 | 810 | 1.05 ± 0.42 | 1.02 |
| 12 | M3 | 25 | 400 | P4 | 1110 | 1 ± 0.45 | 1.00 |

The heat flow rate was measured by burying a thermocouple in a mold material, and the time average of Experiment No. 12 was considered as 1. The mold surface temperature was estimated from the results of mold temperature measurement.
It is clear from the results of the measurement of heat flow rates that the mold of this invention (Experiment Nos. 1, 2, 5, 6, 7) produces only a little air gap layer and is uniformly cooled. The crack in the cast piece is significantly decreased.
*The value at a position 200 mm below the meniscus

TABLE 4

| Mold Oscillation Condition | | | Forward and Backward Pattern of Mold | Backward Distance of Mold (mm) | Casting Speed (m/min) | Oscillation Mark Depth ($d_1$) (mm) | Segregation Layer Depth ($d_2$) (mm) | Mold Material | Mold Powder | Surface Longitudinal Crack |
|---|---|---|---|---|---|---|---|---|---|---|
| | Amplitude | Oscillation Frequency | | | | | | | | |
| Method of This Invention | 3 | 180 | Fig. 7 (b) | 0.2 | 0.7 | 0.25 | 0.30 | M-1 | P-4 | 0.7 |
| Method of This Invention | 3 | 180 | Fig. 7 (b) | 0.5 | 0.7 | 0.20 | 0.26 | M-1 | P-4 | 0.6 |
| Method of This Invention | 3 | 180 | Fig. 7 (b) | 0.5 | 0.7 | 0.20 | 0.26 | M-1 | P-4 | 0.6 |
| Method of This Invention | 3 | 180 | Fig. 7 (b) | 0.5 | 0.7 | 0.18 | 0.20 | M-1 | P-1 | 0.25 |
| Conventional Method | 3 | 180 | — | 0 | 0.7 | 0.62 | 0.70 | M-3 | P-4 | 1.0 (Reference) |

What is claimed is:

1. In a continuous casting method of continuously casting steel while adding a mold powder using a vertical continuous casting mold having two pairs of mold surfaces which form a casting cavity, the improvement comprising maintaining a surface temperature of said mold at 700° C. or more by forming said mold surfaces of a Ni-Cr alloy having low thermal conductivity, and maintaining said mold powder in a liquid-phase state by using a mold powder having a solidifying point lower than said surface temperature.

2. A continuous casting method according to claim 1, including the step of adjusting the inflow of said mold powder for casting steel while longitudinally oscillating said mold.

3. A continuous casting method according to claim 1, including the step of transversely oscillating the mold in the direction in which the distance between a pair of mold surfaces is changed in synchronism with a longitudinal oscillation of said mold so that the phase of the transverse oscillation relative to the longitudinal oscillation is changed.

4. A continuous casting method according to claim 2, including the step of transversely oscillating the mold in the direction in which the distance between a pair of mold surfaces is changed in synchronism with a longitudinal oscillation of said mold so that the phase of the transverse oscillation relative to the longitudinal oscillation is changed.

* * * * *